US009456263B1

(12) United States Patent
Oliveira

(10) Patent No.: US 9,456,263 B1
(45) Date of Patent: Sep. 27, 2016

(54) MICROPHONE MASK

(71) Applicant: Wayne Oliveira, East Providence, RI (US)

(72) Inventor: Wayne Oliveira, East Providence, RI (US)

( * ) Notice: Subject to any disclaimer, the term of this patent is extended or adjusted under 35 U.S.C. 154(b) by 0 days.

(21) Appl. No.: 14/734,049

(22) Filed: Jun. 9, 2015

(51) Int. Cl.
*H04R 9/08* (2006.01)
*H04R 1/08* (2006.01)

(52) U.S. Cl.
CPC ..... *H04R 1/083* (2013.01)

(58) Field of Classification Search
CPC .. A62B 18/084; H04B 1/385; G10L 21/0208
USPC ..... 381/361, 87, 333, 353, 354, 359, 366; 184/21
See application file for complete search history.

(56) References Cited

U.S. PATENT DOCUMENTS 4,129,754 A 12/1978 Gore
6,179,666 B1 * 1/2001 Osborn ..... H04B 1/385 439/669
6,285,772 B1 9/2001 Tate
6,493,451 B2 12/2002 Paritsky
7,221,966 B2 5/2007 Birli
7,302,072 B2 * 11/2007 Skillicorn ..... H04R 1/08 128/201.19
7,783,034 B2 * 8/2010 Manne ..... H04M 1/05 379/441
8,391,529 B2 3/2013 Herman
2003/0224838 A1 * 12/2003 Skillicorn ..... H04R 1/083 455/575.2
2006/0286933 A1 * 12/2006 Harkins ..... A42B 3/30 455/41.2
2007/0116314 A1 5/2007 Grilliot
2009/0052714 A1 2/2009 Wilbur
2010/0098283 A1 * 4/2010 Babasaki ..... H04R 1/08 381/361
2010/0169073 A1 * 7/2010 Almagro ..... G10L 15/26 704/3
2013/0156246 A1 6/2013 Menyhart
2014/0169612 A1 * 6/2014 Shih ..... H04R 27/04 381/388

* cited by examiner

*Primary Examiner* — Curtis Kuntz
*Assistant Examiner* — Julie X Dang
(74) *Attorney, Agent, or Firm* — Kyle A. Fletcher, Esq.

(57) ABSTRACT

The microphone mask is a device that is adapted to be positioned adjacent a mouth of a user in order to communicate with a portable radio. Moreover, the microphone mask includes a speaker adjacent to the microphone such that the microphone mask is adapted to be positioned adjacent a user's ear in order to hear sound associated with use in communicating via a portable radio. The microphone mask includes a wire that plugs into a portable radio, or a cellular telephone, or other electronic device. The microphone mask is further defined with an inner surface that includes the microphone and the speaker therein. The outer surface includes a push button that controls use of the microphone. The microphone mask is further defined with a perimeter edge that is adapted to interface with skin surrounding the mouth of the user.

12 Claims, 4 Drawing Sheets

MICROPHONE MASK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of microphones, more specifically, a microphone that is adapted to be positioned against a mouth of a user in order to speak via a portable radio where ambient noise is present.

SUMMARY OF INVENTION

The microphone mask is a device that is adapted to be positioned adjacent a mouth of a user in order to communicate with a portable radio. Moreover, the microphone mask includes a speaker adjacent to the microphone such that the microphone mask is adapted to be positioned adjacent a user's ear in order to hear sound associated with use in communicating via a portable radio. The microphone mask includes a wire that plugs into a portable radio, or a cellular telephone, or other electronic device. The microphone mask is further defined with an inner surface that includes the microphone and the speaker therein. The outer surface includes a push button that controls use of the microphone. The microphone mask is further defined with a perimeter edge that is adapted to interface with skin surrounding the mouth of the user. The perimeter edge is a curvilinear in order to contour to the skin surrounding the mouth of the user.

These together with additional objects, features and advantages of the microphone mask will be readily apparent to those of ordinary skill in the art upon reading the following detailed description of the presently preferred, but nonetheless illustrative, embodiments when taken in conjunction with the accompanying drawings.

In this respect, before explaining the current embodiments of the microphone mask in detail, it is to be understood that the microphone mask is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the microphone mask.

It is therefore important that the claims be regarded as including such equivalent construction insofar as they do not depart from the spirit and scope of the microphone mask. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
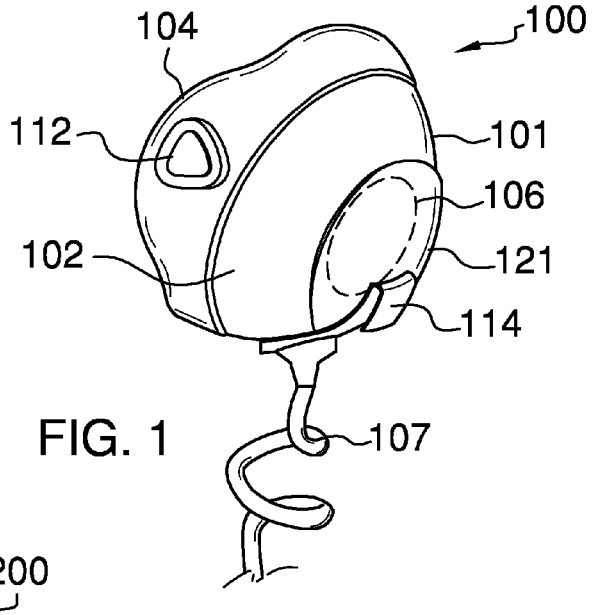
FIG. 1 is a perspective view of an embodiment of the disclosure.
Figure 2:
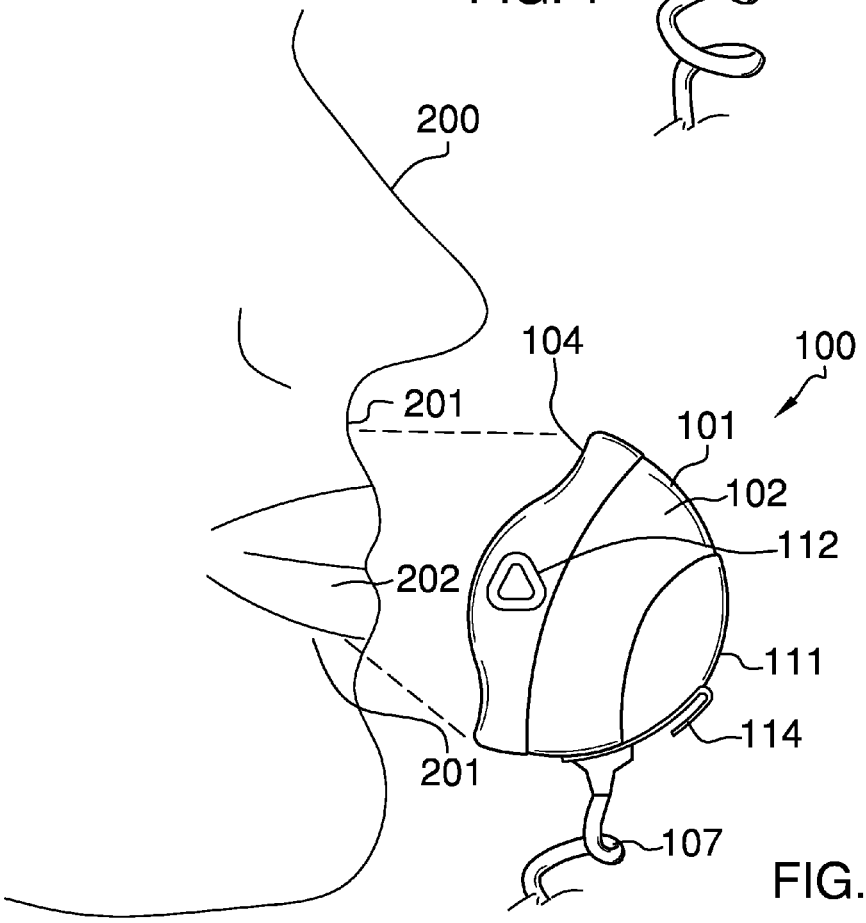
FIG. 2 is a side view of an embodiment of the disclosure.
Figure 3:
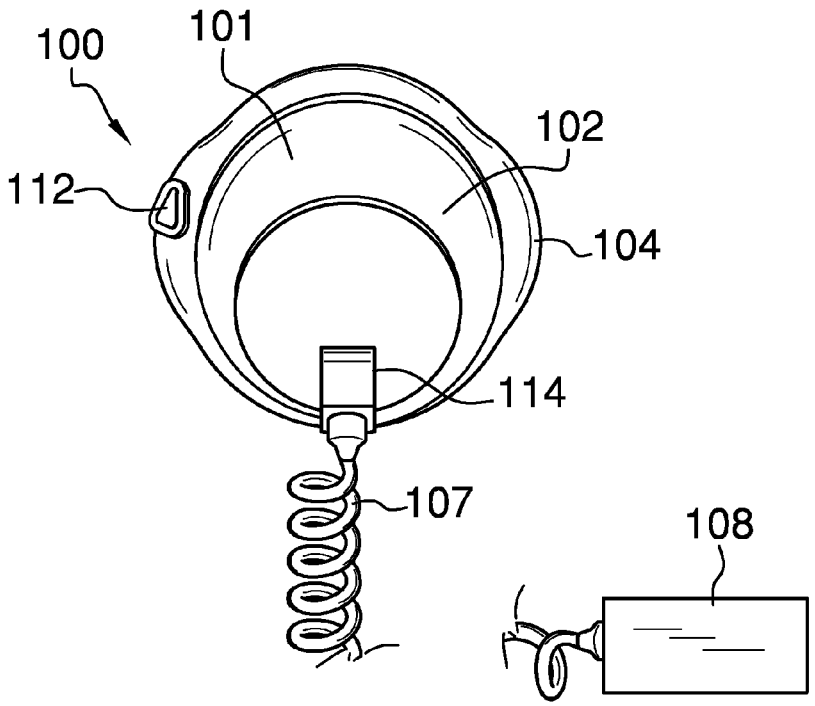
FIG. 3 is a front view of an embodiment of the disclosure.
Figure 4:
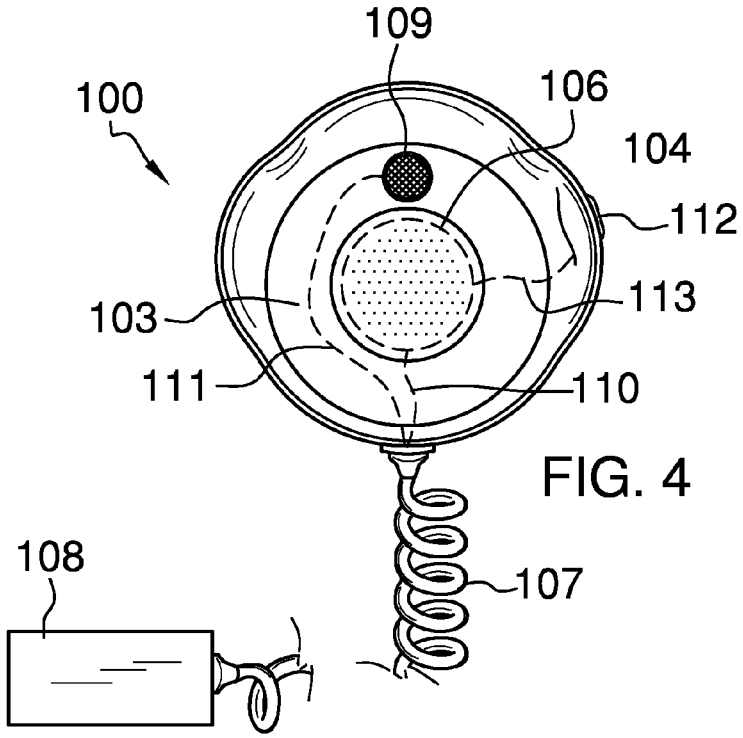
FIG. 4 is a rear view of an embodiment of the disclosure.
Figure 5:
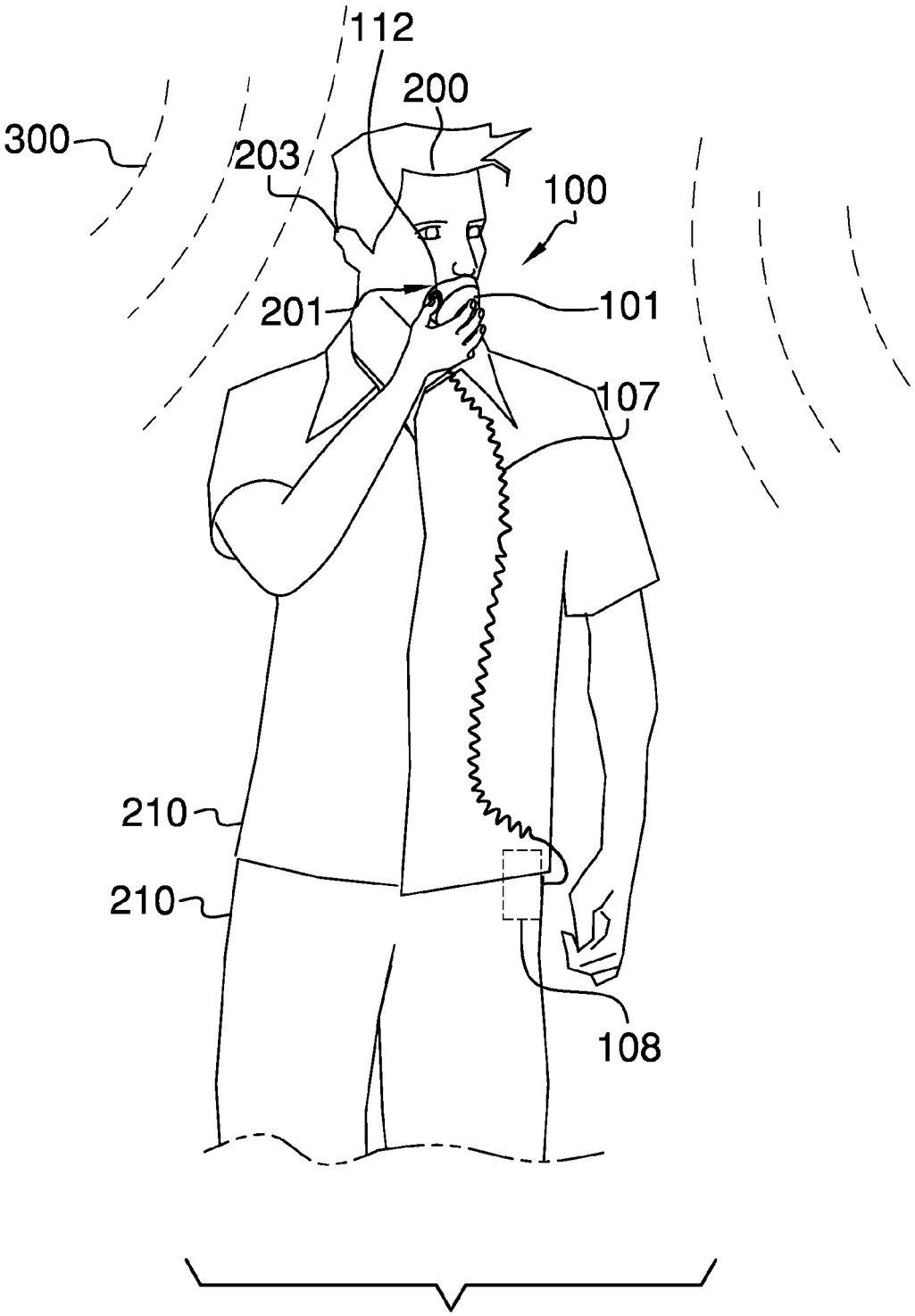
FIG. 5 is a view of an embodiment of the disclosure in use with the mouth of the user.
Figure 6:
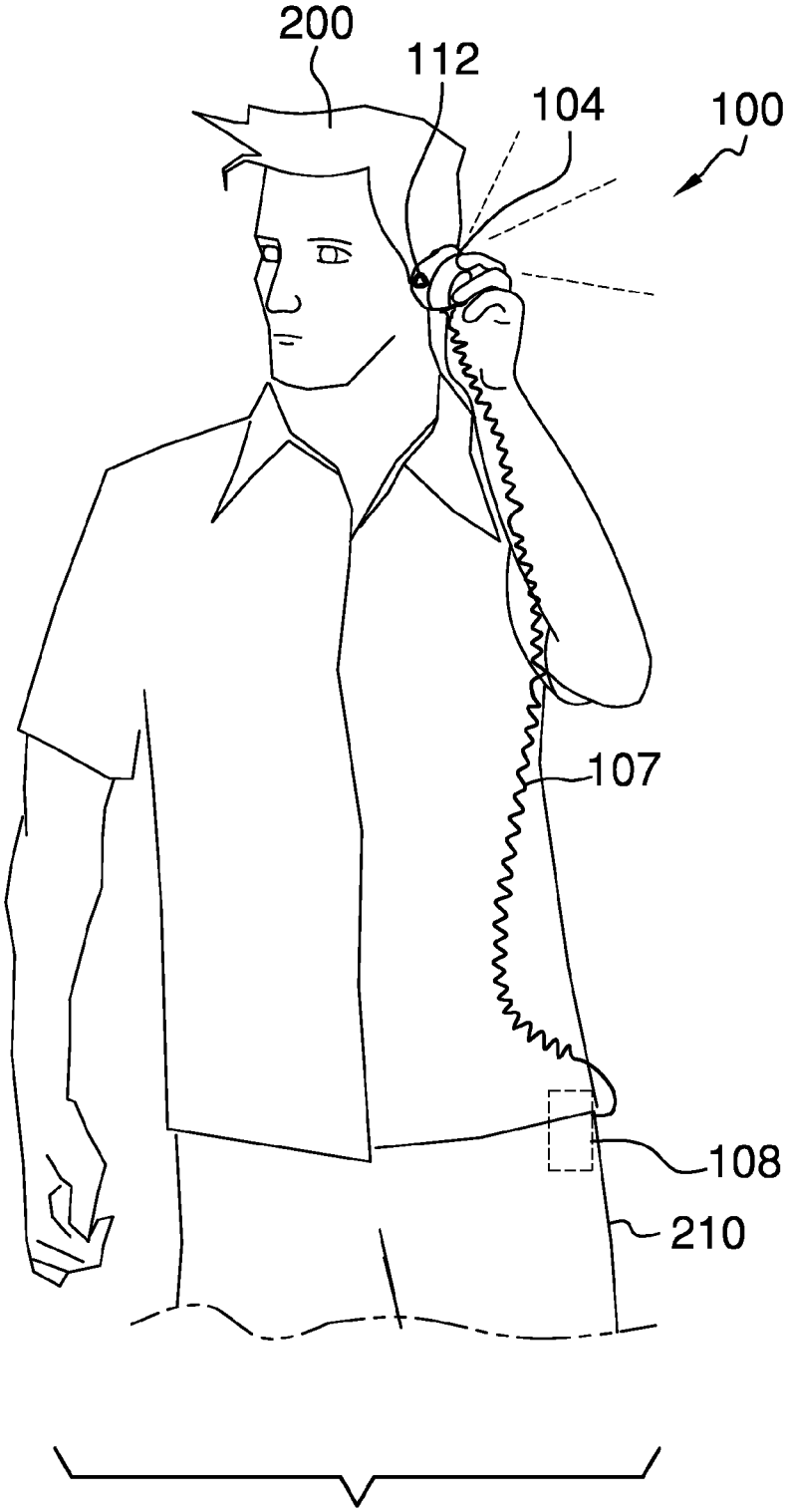
FIG. 6 is another view of an embodiment of the disclosure in use with the ear of the user.

Detailed reference will now be made to a first potential embodiment of the disclosure, which is illustrated in FIGS. 1 through 6. The microphone mask 100 (hereinafter invention) comprises a mask 101 that is further defined with an outer surface 102, an inner surface 103, and a perimeter edge 104. The perimeter edge 104 is curvilinear, which means that the perimeter edge has a shape that is adapted to contour with an end user 200. The perimeter edge 104 is adapted to be positioned against skin 201 of the end user 200. Moreover, the skin 201 of the end user 200 immediately surrounds a mouth 202 of the end user 200 or involves an ear 203 of the end user 200.

The mask 101 is a device that is solely able to cover the mouth 202 of the end user 200 or be positioned against the ear 203 of the end user 200. The mask 101 is cup-shaped such that the inner surface 103 is concave, whereas the outer surface 102 is convex.

The inner surface 103 of the mask 101 includes a microphone 106. The microphone 106 is concentrically located with respect to the inner surface 103 of the mask 101. Moreover, the microphone 106 is located adjacent to a forward, bottom portion 121 of the mask 101.

The microphone 106 is connected to an electrical cord 107 that extends away from the mask 101. The electrical cord 107 is able to connect with an electronic device 108. It shall be noted that the term electronic device 108 is being used to refer to a portable radio, a CB radio, a cellular telephone, an electronic megaphone, or other electrical device that is able to record and/or transmit the sound generated via the mouth 202.

The inner surface 103 of the mask 101 includes a speaker 109. The speaker 109 is adjacent to the microphone 106. The speaker 109 is connected to the electrical cord 107. Both, the microphone 106 and the speaker 109 are able to connect with the electronic device 108 via the electrical cord 107. A microphone wire 110 extends from the microphone 106, and to the electrical cord 107. A speaker wire 111 extends from the speaker 109, and to the electrical cord 107.

Located on the outer surface 102 of the mask 101 is a push button 112. The push button 112 controls operation of the microphone 106. Moreover, upon depression of the push button 112, the microphone 106 is operable. The push button 112 includes a button wire 113 that is connected thereto. The button wire 113 connects between the push button 112 and the microphone 106. The button wire 113 enables the push button 112 to turn on/off the microphone 106.

The mask 101 also includes a clip 114 that is provided on the outer surface 102. The clip 114 is able to enable the mask 101 to be hooked onto an object, such as a belt or a pocket associated with garments 210 of the end user 200. The clip 114 may be proximate the forward, bottom portion 121 of the mask 101.

In use, the mask 101 is able to reduce or abate ambient noise 300 from interacting with the microphone 106 when in use with the mouth 202 of the end user 200. The shape of the mask 101 in connection with the perimeter edge 104 and location of the microphone 106 on the inner surface 103 reduces ambient noise 300 from reaching the microphone 106 thereby providing improved use of the electronic device 108 in a noisy environment. The same can be said for the use of the speaker 109 relative to the ear 203 of the end user 200 in a noisy environment.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A microphone and speaker mask comprising: a mask adapted to be positioned over a mouth of an end user; said mask is also adapted to be positioned over an ear of said end user; wherein the mask includes a microphone as well as a speaker in order to provide two-way communication with the end user via an electronic device attached to the end user; wherein the mask is adapted to reduce ambient noise from reaching the microphone and speaker, which both the microphone and speaker are located on an inner surface of the mask; wherein the mask is further defined with an outer surface, an inner surface, and a perimeter edge; wherein the inner surface of the mask includes the speaker; wherein the speaker is adjacent to the microphone; wherein located on the outer surface of the mask is a push button; wherein the push button controls operation of the microphone; wherein the mask includes a clip that is provided on the outer surface to enable the mask to be hooked onto an object associated with garments of the end user.

2. The microphone mask according to claim 1 wherein the perimeter edge is curvilinear, and is adapted to contour with an end user; wherein the perimeter edge is adapted to be positioned against skin of the end user; wherein the skin of the end user immediately surrounds the mouth of the end user or the ear of the end user.

3. The microphone mask according to claim 2 wherein the mask is solely able to cover the mouth of the end user or be positioned against the ear of the end user; wherein the mask is cup-shaped such that the inner surface is concave, whereas the outer surface is convex.

4. The microphone mask according to claim 3 wherein the inner surface of the mask includes the microphone; wherein the microphone is concentrically located with respect to the inner surface of the mask.

5. The microphone mask according to claim 4 wherein the microphone is located adjacent to a forward, bottom portion of the mask.

6. The microphone mask according to claim 5 wherein the microphone is connected to an electrical cord that extends away from the mask.

7. The microphone mask according to claim 6 wherein the electrical cord is able to connect with the electronic device.

8. The microphone mask according to claim 7 wherein the speaker is connected to the electrical cord; wherein both, the microphone and the speaker are able to connect with the electronic device via the electrical cord.

9. The microphone mask according to claim 8 wherein a microphone wire extends from the microphone, and to the electrical cord.

10. The microphone mask according to claim 9 wherein a speaker wire extends from the speaker, and to the electrical cord.

11. The microphone mask according to claim 10 wherein upon depression of the push button, the microphone is operable; wherein the push button includes a button wire that is connected thereto; wherein the button wire connects between the push button and the microphone; wherein the button wire enables the push button to turn on/off the microphone.

12. The microphone mask according to claim 5 wherein the clip is proximate the forward, bottom portion of the mask.

* * * * *